United States Patent [19]

Ward

[11] 4,179,031

[45] Dec. 18, 1979

[54] DOCUMENT DISPENSING SYSTEM

[75] Inventor: Stephen W. Ward, Dayton, Ohio

[73] Assignee: NCR Corporation, Dayton, Ohio

[21] Appl. No.: 904,957

[22] Filed: May 11, 1978

[51] Int. Cl.[2] ..... B07C 5/00

[52] U.S. Cl. ..... 209/534; 209/566; 209/657; 271/258; 271/265; 235/92 SB

[58] Field of Search ..... 209/534, 564, 563, 565, 209/566, 657; 271/64, 265, 258; 340/259, 149 A; 364/401, 405, 408; 235/92 SB

[56] References Cited

U.S. PATENT DOCUMENTS

| | | | |
|---|---|---|---|
| 3,818,461 | 6/1974 | Ward | 340/172.5 |
| 3,937,925 | 2/1976 | Boothroyd | 235/61.7 B |
| 3,941,977 | 3/1976 | Voss | 235/61.7 B |
| 3,948,510 | 4/1976 | Iwamoto | 271/258 |
| 3,949,200 | 4/1976 | Shigemori | 235/92 SB |
| 3,949,368 | 4/1976 | West | 340/172.5 |
| 4,022,460 | 5/1977 | Pritchett | 271/258 |
| 4,084,900 | 4/1978 | Yamaoka | 271/258 |

*Primary Examiner*—Allen N. Knowles
*Attorney, Agent, or Firm*—J. T. Cavender; Albert L. Sessler, Jr.; Elmer Wargo

[57] ABSTRACT

A document dispensing system for dispensing documents or bills from a source to a customer access receptacle or a reject bin depending upon certain characteristics of the bills or the manner in which they are fed. Sensors which are positioned along a dispensing path are sampled to produce first and second states therein in accordance with the presence or absence, respectively, of bills in the dispensing path. The states of the sensors are stored to provide short term and long term histories of the sensors along with a time in transport for each of the bills in the dispensing path. The short and long term histories and the time in transport are utilized for evaluating the status of each of the bills in the dispensing path with regard to predetermined criteria such as, for example, "double thickness", or "bill too long", and for producing a control signal which controls a diverter gate to divert the bills into the access receptacle or reject bin in accordance with the evaluation.

17 Claims, 26 Drawing Figures

FIG. 4

| ENTRIES | INPUT/OUTPUT SENSOR STATUS TABLE NO. 1 | |
|---|---|---|
| | SHORT-TERM HISTORY, 8 BITS | LONG-TERM HISTORY, 8 BIT COUNT |
| SINGLE SENSOR NO. 1 | 00000001 | 00000001 |
| DOUBLES SENSOR NO. 2 | — | — |
| EXIT SENSOR NO. 3 | — | — |
| REJECT SENSOR NO. 4 | — | — |

FIG. 5

| ENTRIES | BILL STATUS TABLE NO.2 | |
|---|---|---|
| | TIME IN TRANSPORT (BT) (8 BITS) | STATUS OF BILL (8 BITS) |
| BILL NO.1 | 0000 1000 | 1000 0000 |
| BILL NO.2 | 0010 0000 | 1000 0000 |
| BILL NO.3 | 0100 1011 | 1000 0000 |
| BILL NO.4 | | |

FIG. 6

| | BILL PROGRESS TABLE NO.3 | |
|---|---|---|
| CHECK POINT | PROGRESS COUNT (BP) (8 BITS) | ADDRESS OF ROUTINE TO CHECK BILL PROGRESS |
| 1 | 0000 0111 FWTSFU | JMP FWFUØØ |
| 2 | 0001 0111 FWTSFC | JMP FWFCØØ |
| 3 | 0010 0001 FWTSDC | JMP FWDCØØ |
| 4 | 0011 0111 FWTSXU | JMP FWXUØØ |
| 5 | 0100 1011 FWTSXC | JMP FWXCØØ |
| 6 | 0110 0100 FWROØØ | JMP FWROØØ |

"READ STATE OF SENSORS" ROUTINE 178

"DETERMINE WHETHER A BILL REQUIRES A PROGRESS CHECK" ROUTINE 192

FIG. 9

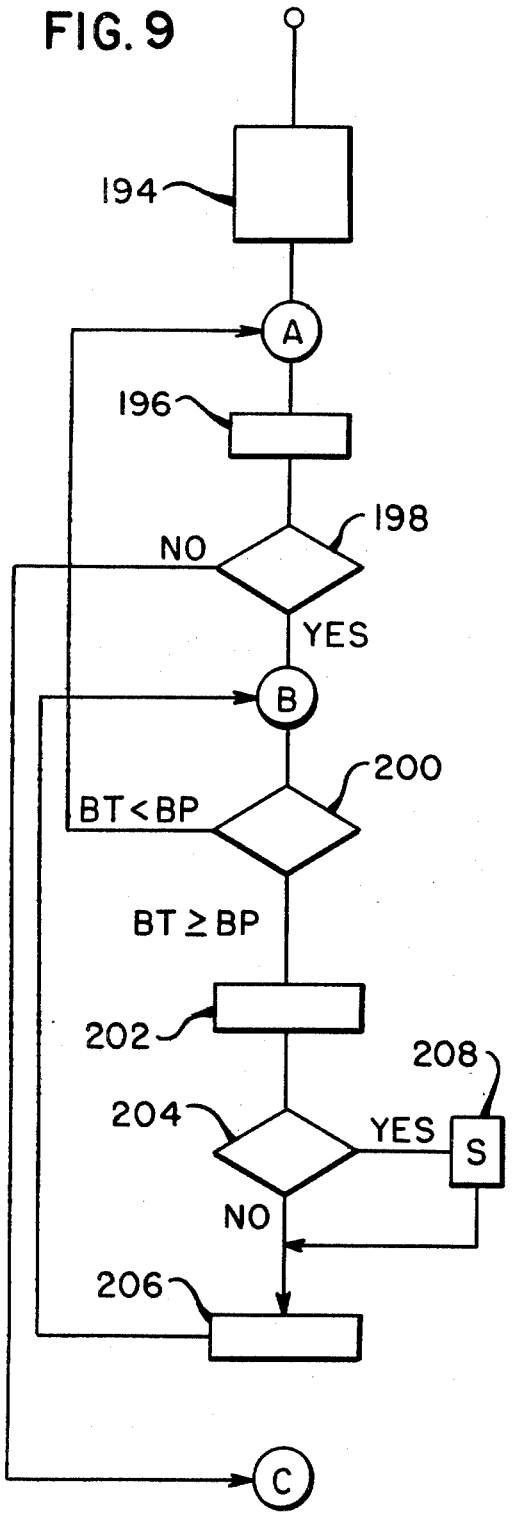

FROM FIG. 7

INITIALIZE POINTERS
1.) POINT TO BILL STATUS TABLE NO. 2
2.) POINT TO BILL PROGRESS TABLE NO. 3

INCREMENT BILL STATUS TABLE NO. 2 POINTER LOAD TIME IN TRANSPORT COUNTER

ARE THERE ANY MORE BILLS IN TRANSPORT ?

COMPARE BILL TIME IN TRANSPORT (BT) TO BILL PROGRESS COUNT (BP)

INCREMENT (TABLE NO. 3) POINTER

IS BT = BP ?
S = SUBROUTINE TO CHECK ON PROGRESS OF A BILL

INCREMENT BP (TABLE NO. 3) POINTER

CONTINUE

FIG. 10

READ STATE OF SENSORS ROUTINE

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 06C4 | | FWIORS: | | | |
| 06C4 | E5 | | PUSH | H | |
| 06C5 | CDAA06 | | CALL | FWIODI | ;READ SENSOR LEVELS IN A. |
| 06C8 | EE0F | | XRI | FWPPCB | ;COMPLEMENT STATES OF POSITIVE CLEAR SENSORS. |
| 06CA | 211B00 | | LXI | H,FWHIOS | ;ADDR I/O SENSORS STATUS TABLE #1 |
| 06CD | 19 | | DAD | D | |
| 06CE | 0E04 | | MVI | C,4 | ;FOUR SENSORS TO SCAN. |
| 06D0 | | FWIOR0: | | | |
| 06D0 | 0F | | RRC | | ;SENSOR STATE IN CARRY. |
| 06D1 | 47 | | MOV | B,A | |
| 06D2 | 7E | | MOV | A,M | |
| 06D3 | 17 | | RAL | | ;ROTATE CARRY INTO HISTORY BYTE. |
| 06D4 | 77 | | MOV | M,A | |
| 06D5 | 0F | | RRC | | ;RESTORE CARRY. |
| 06D6 | 23 | | INX | H | |
| 06D7 | 7E | | MOV | A,M | ;BILL PRESENT COUNTER. |
| 06D8 | CE00 | | ACI | 0 | ;ADD 1 IF SENSOR BLOCKED. |
| 06DA | 77 | | MOV | M,A | |
| 06DB | 23 | | INX | H | |
| 06DC | 78 | | MOV | A,B | |
| 06DD | 0D | | DCR | C | |
| 06DE | C2D006 | | JNZ | FWIOR0 | ;SCAN AND RECORD ALL 4 SENSORS. |
| 06E1 | E1 | | POP | H | |
| 06E2 | EB | | XCHG | | |
| 06E3 | C9 | | RET | | |

FIG. 11A

DETERMINE WHETHER A BILL REQUIRES A PROGRESS CHECK ROUTINE

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 02F2 | | FWML12: | | | |
| 02F2 | C1 | | POP | B | ;CURRENT BILL TIME AND STATUS TABLE #2 ADDR LESS 1. |
| 02F3 | 21BE00 | | LXI | H,FWDBPC | ;ADDR BILL PROGRESS CHECK TIME TABLE. |
| 02F6 | | FWML13: | | | |
| 02F6 | 03 | | INX | B | |
| 02F7 | 0A | | LDAX | B | ;BILL SCAN COUNTER. |
| 02F8 | 03 | | INX | B | ;ADDR BILL STATUS BYTE. |
| 02F9 | B7 | | ORA | A | |
| 02FA | CA1303 | | JZ | FWML16 | ;JMP IF ALL BILLS HAVE BEEN CHECKED. |
| 02FD | | FWML14: | | | |
| 02FD | BE | | CMP | M | ;COMPARE WITH COUNTER VALUE OF A PROGRESS CHECK T |
| 02FE | DAF602 | | JC | FWML13 | ;JMP BILL COUNTER LESS THAN TABLE COUNTER. ;BUMP TO PREVIOUS BILL WHOSE COUNTER WILL BE GREA |
| 0301 | 23 | | INX | H | ;ADDR OF BILL PROGRESS CHECK SUBROUTINE. |
| 0302 | CC0B03 | | CZ | FWML15 | ;INDIRECT CALL IF BILLS PROGRESS NEEDS CHECKING. |
| 0305 | 23 | | INX | H | |
| 0306 | 23 | | INX | H | |
| 0307 | 23 | | INX | H | ;ADDR NEXT ENTRY IN PROGRESS CHECK TABLE #3. |
| 0308 | C3FD02 | | JMP | FWML14 | |
| 030B | | FWML15: | | | |
| 030B | F5 | | PUSH | PSW | |
| 030C | E5 | | PUSH | H | |
| 030D | CDA906 | | CALL | FWIOPC | |
| 0310 | E1 | | POP | H | |
| 0311 | F1 | | POP | PSW | |
| 0312 | C9 | | RET | | |

FIG. 11B

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 0313 | | FWML16: | | | |
| | | CHECK SENSORS FOR CLEAR, IF TRANSPORT EMPTY | | | |
| 0313 | 211200 | | LXI | H,FWHBTS | |
| 0316 | 19 | | DAD | D | |
| 0317 | 7E | | MOV | A,M | ;CURRENT BILL TIMER. |
| 0318 | B7 | | ORA | A | |
| 0319 | C23D03 | | JNZ | FWML17 | ;JMP IF XPORT NOT EMPTY. |
| 031C | 210D00 | | LXI | H,FWHSTM | ;DO NOT CHECK, IF ALREADY INOP. |
| 031F | 19 | | DAD | D | |
| 0320 | 7E | | MOV | A,M | |
| 0321 | E608 | | ANI | FWSNOP | |
| 0323 | C23D03 | | JNZ | FWML17 | |
| 0326 | 212100 | | LXI | H,FWHIOS+6 | |
| 0329 | 19 | | DAD | D | |
| 032A | 7E | | MOV | A,M | ;REJECT SENSOR HISTORY. |
| 032B | 0F | | RRC | | |
| 032C | AE | | XRA | M | ;LEAST SIGNIF. BIT SET IF TRANSITION. |
| 032D | 2B | | DCX | H | |
| 032E | 2B | | DCX | H | |
| 032F | B6 | | ORA | M | ;EXIT SENSOR HISTORY. |
| 0330 | 2B | | DCX | H | |
| 0331 | 2B | | DCX | H | |
| 0332 | B6 | | ORA | M | ;DOUBLES SENSOR HISTORY. |
| 0333 | 2B | | DCX | H | |
| 0334 | 2B | | DCX | H | |
| 0335 | B6 | | ORA | M | ;FIRST SENSOR HISTORY. |
| 0336 | 0F | | RRC | | ;ALL 4 MUST INDICATE CLEAR. |
| 0337 | 210428 | | LXI | H,(FWSHWM+FWSNOP)*256+FWAMLC | |
| 033A | DCFC04 | | CC | FWSTMS | ;SET STATUS, IF SENSOR NOT CLEAR. |
| 033D | | FWML17: | | | |
| 033D | 211100 | | LXI | H,FWHSTT | ;RETURN XPORT STATUS. |
| 0340 | 19 | | DAD | D | |
| 0341 | 7E | | MOV | A,M | |
| 0342 | E1 | | POP | H | |
| 0343 | EB | | XCHG | | |
| 0344 | C9 | | RET | | ;RETURN TO MAIN LINE. |

FIG. 12

BILL PROGRESS CHECK ROUTINES (TABLE #3)

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 00BE | | FWDBPC: | | | |
| 00BE | 07 | | DB | FWTSFU | ;CHECK POINT 1, BILL UNDER FIRST SENSOR TIME. ALSO FEED CNTL. |
| 00BF | C39A03 | | JMP | FWFUØØ | |
| 00C2 | 17 | | DB | FWTSFC | ;CHECK POINT 2, BILL CLEAR OF 1ST SENSOR TIME. ALSO DIVERTER CNT |
| 00C3 | C3C403 | | JMP | FWFCØØ | |
| 00C6 | 21 | | DB | FWTSDC | ;CHECK POINT 3, DIVERTER IN DIVERT POSITION CHECK TIME. |
| 00C7 | C32A04 | | JMP | FWDCØØ | |
| 00CA | 37 | | DB | FWTSXU | ;CHECK POINT 4, BILL UNDER EXIT OR REJECT SENSOR TIME. |
| 00CB | C36E04 | | JMP | FWXUØØ | |
| 00CE | 4B | | DB | FWTSXC | ;CHECK POINT 5, BILL CLEAR OF EXIT OR REJECT SENSOR TIME. |
| 00CF | C3BA04 | | JMP | FWXCØØ | |
| 00D2 | 64 | | DB | FWTSRO | ;CHECK POINT 6, OVERLENGTH BILL CLEAR OF REJECT SENSOR TIME. |
| 00D3 | C3E604 | | JMP | FWROØØ | |
| 00D6 | FF | | DB | OFFH | ;END OF TABLE. HIGHEST POSSIBLE TIME. |

FIG. 13

BILL STATUS CODES (TABLE #2)

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 0001 | | FWHBOL | EQU | 01H | ;OVERLENGTH BILL STATUS. |
| 0002 | | FWHBDB | EQU | 02H | ;DOUBLE BILL STATUS. |
| 0004 | | FWHBSB | EQU | 04H | ;BILL TOO SHORT STATUS. |
| 0008 | | FWHBLB | EQU | 08H | ;BILL TOO LONG STATUS. |
| 0010 | | FWHBXB | EQU | 10H | ;EXTRA BILL PICKED STATUS. |
| 0020 | | FWHBXU | EQU | 20H | ;BILL UNDER XIT OR REJ. SENS. ZCNBC. |
| 0040 | | FWHBDV | EQU | 40H | ;BILL TO BE DIVERTED STATUS. ZCNBC. |
| 0080 | | FWHBPN | EQU | 80H | ;BILL PRESENT STATUS. ZCNBC. |

FIG. 14 A

TIMING DEFINITIONS (IN MILLISECONDS)

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 000A | | FWTSCN | EQU | 10 | ;SCAN PERIOD. |
| 0024 | | FWTSCY | EQU | 360/FWTSCN | ;BILL FEED CYCLE COUNT. ZSTS. |
| 0046 | | FWTSTS | EQU | 700/FWTSCN | ;TIME FOR TRANSPORT TO STOP COUNT. |
| 0019 | | FWTSMO | EQU | 250/FWTSCN | ;TIME FOR MOTOR TO GET STARTED. |
| 02D0 | | FWTSRT | EQU | FWTSCY*20 | ;CONSTANT PICK COUNT LIMIT. |
| 003B | | FWTTBB | EQU | 59 | ;MIN TIME ALLOWED BETWEEN BILLS. |
| 0005 | | FWTSBB | EQU | 59/FWTSCN | ;MIN SCAN COUNT BETWEEN BILLS. |
| | | NEW BILL DETECTION TIMING. | | | |
| 000F | | FWTHCB | EQU | 0FH | ;SET 1 BITS FOR CLEAR TIME BETWEEN BILLS. ZRJHC. |
| 0001 | | FWTHNB | EQU | 01H | ;SET 1 BITS FOR MIN NEW BILL SEEN TIME ZRJHC. |
| 0001 | | FWTSNC | EQU | 1 | ;COUNT OF NO. OF 1↑S IN WTHNB. |
| | | DOUBLE BILL DETECTION TIMING. | | | |
| 0007 | | FWTHDD | EQU | 07H | ;SET 1 BITS FOR MIN DOUBLE BILL SEEN TIME. ZRJHC. |
| | | BILL UNDER FIRST SENSOR AND FEED DE-ACTIVATE TIMING. | | | |
| 0007 | | FWTSFU | EQU | 70/FWTSCN | ;SCAN COUNT WHEN TIME TO TURN FEED OFF. |
| 0007 | | FWTCFS | EQU | FWTSFU | ;MIN BILL SEEN COUNT AT WTSFU TIME. |

FIG. 14B

BILL CLEAR OF FIRST SENSOR AND DIVERTER CONTROL TIMING.

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 0017 | | FWTSFC | EQU | 230/FWTSCN | ;TIME FOR LONGEST BILL TO CLEAR FIRST SENSOR. |
| 0001 | | FWTHFC | EQU | 01H | ;SET 1 BITS FOR MIN CLEAR TIME. ZRJHC. |
| 0002 | | FWTSSM | EQU | 20/FWTSCN | ;SHORT BILL MARGIN FROM AVG. |
| 0002 | | FWTSLM | EQU | 20/FWTSCN | ;LONG BILL MARGIN FROM AVG. |

VERIFY DIVERTER IN DIVERT POSITION TIMING.

| | | | | | |
|---|---|---|---|---|---|
| 0021 | | FWTSDC | EQU | 330/FWTSCN | ;DIVERTER IN DIVERT POSITION COUNT. |
| 000A | | FWTDLM | EQU | 10 | ;MAX DIVERT COUNT PER OPERATION. |

BILL UNDER EXIT OR REJECT SENSORS TIMING.

| | | | | | |
|---|---|---|---|---|---|
| 0037 | | FWTSXU | EQU | 550/FWTSCN | ;BILL UNDER EXIT OR REJECT SENSOR SCAN COUNT. |
| 0003 | | FWTCXJ | EQU | 3 | ;BILL SEEN COUNT. |
| 0002 | | FWTCRJ | EQU | 2 | ;BILL UNDER EXIT SEEN COUNT WHEN BILL REJECTED. |

LONGEST BILL CLEAR OF EXIT OR REJECT SENSORS TIMING.

| | | | | | |
|---|---|---|---|---|---|
| 004B | | FWTSXC | EQU | 750/FWTSCN | ;LONGEST BILL CLEAR OF EXIT SCAN COUNT. ZSTS. |
| 0003 | | FWTHXC | EQU | 03H | ;SET 1 BITS FOR MIN EXIT CLEAR TIME AFTER BILL. Z |

OVERLENGTH BILL CLEAR OF REJECT SENSOR TIMING.

| | | | | | |
|---|---|---|---|---|---|
| 0064 | | FWTSRO | EQU | 1000/FWTSCN | ;LONGEST OVERLENGTH BILL CLEAR OF REJECT. |

FIG. 15

BILL UNDER FIRST SENSOR

```
MEMORY    MACHINE
LOCATION  EXECUTABLE   SYMBOLIC  OPERATIONAL
          INSTRUCTIONS  LABELS     CODES      OPERANDS    DESCRIPTION

                       ;ON ENTRY:              BC = CURRENT BILL STATUS.
                       ;                       DE = ZHLIA.
                       ;ON RETURN:             BC, DE SAVED.
                       ;
039A                   FWFUØØ:
039A      211C00                  LXI         H,FWHIOS+1
039D      19                      DAD         D
039E      7E                      MOV         A,M         ;SINGLES SENSOR
                                                           COUNTER.
039F      FE07                    CPI         FWTCFS      ;MUST HAVE EXACTLY
                                                           WTCFS SINGLE
                                                           DETECTS.
03A1      CAA803                  JZ          FWFU01      ;JMP IF BILL WAS
                                                           PRESENT ON EACH
                                                           SCAN.
03A4      0A                      LDAX        B           ;CURRENT BILL
                                                           STATUS.
03A5      F644                    ORI         FWHBSB+FWHBDV
03A7      02                      STAX        B           ;DIVERT SHORT BILL.
03A8                   FWFU01:
03A8      3E40                    MVI         A,FWHBDV    ;DO NOT COUNT
                                                           DIVERTED BILLS.
03AA      CD5C05                  CALL        FWSTPG      ;CHECK IF BILLS
                                                           PICKED STILL LESS
                                                           THAN GOAL.
03AD      0A                      LDAX        B
03AE      67                      MOV         H,A         ;BILL STAT IN H.
03AF      DABE03                  JC          FWFU03      ;JMP IF PICKED LESS
                                                           THAN GOAL.
03B2      CAB903                  JZ          FWFU02      ;JMP IF PICKED
                                                           EQUALS GOAL.
03B5      0A                      LDAX        B
03B6      F650                    ORI         FWHBXB+FWHBDV;DIVERT EXTRA BILL.
03B8      02                      STAX        B
03B9                   FWFU02:
03B9      3E21                    MVI         A,FWPFCB+FWPFSB
03BB      CDE406                  CALL        FWIOMC      ;TURN FEED OFF, IF
                                                           PICKED>=GOAL.
03BE                   FWFU03:
03BE      3E07                    MVI         A,FWPEFI
03C0      CDBD06                  CALL        FWIOCO      ;ENABLE TRAILING
                                                           EDGE INTERRUPT.
03C3      C9                      RET
```

FIG. 16A

BILL CLEAR OF FIRST SENSOR AND DIVERTER CONTROL

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| | | ;ON ENTRY: | | BC = CURRENT BILL STATUS. | |
| | | ; | | DE = ZHLIA. | |
| | | ;ON RETURN: | | BC, DE SAVED. | |
| | | ; | | | |
| 03C4 | | FWFCØØ: | | | |
| 03C4 | 211B00 | | LXI | H,FWHIOS | ;SINGLES SENSOR HISTORY. |
| 03C7 | 19 | | DAD | D | |
| 03C8 | 7E | | MOV | A,M | |
| 03C9 | E601 | | ANI | FWTHFC | ;CHECK FOR SINGLES CLEAR. |
| 03CB | CAD703 | | JZ | FWFC01 | ;JMP IF CLEAR. |
| 03CE | 0A | | LDAX | B | ;DIVERT OVERLENGTH BILL. |
| 03CF | F641 | | ORI | FWHBOL+FWHBDV | |
| 03D1 | 02 | | STAX | B | |
| 03D2 | 3E21 | | MVI | A,FWPFCB+FWPFSB | |
| 03D4 | CDE406 | | CALL | FWIOMC | ;TURN FEED OFF. |
| 03D7 | | FWFC01: | | | |
| 03D7 | 23 | | INX | H | ;SINGLES DETECT COUNTER. |
| 03D8 | 7E | | MOV | A,M | |
| 03D9 | 210500 | | LXI | H,FWHAVG | ;AVERAGE BILL LENGTH. |
| 03DC | 19 | | DAD | D | |
| 03DD | D603 | | SUI | FWTSLM+1 | ;SUB LONG BILL MARGIN FROM BILL LENGTH. |
| 03DF | BE | | CMP | M | ;COMPARE WITH AVG. |
| 03E0 | DAE903 | | JC | FWFC02 | ;JMP IF BILL LENGTH NOT GREATER THAN AVG+WHSLM. |
| 03E3 | F5 | | PUSH | PSW | |
| 03E4 | 0A | | LDAX | B | |
| 03E5 | F648 | | ORI | FWHBLB+FWHBDV | ;DIVERT LONG BILL. |
| 03E7 | 02 | | STAX | B | |
| 03E8 | F1 | | POP | PSW | |
| 03E9 | | FWFC02: | | | |
| 03E9 | C605 | | ADI | FWTSLM+1+FWTSSM | ;ADD SHORT BILL MARGIN TO BILL LENGTH |
| 03EB | BE | | CMP | M | ;COMPARE WITH AVG. |
| 03EC | D2F503 | | JNC | FWFC03 | ;JMP IF BILL LENGTH NOT LESS THAN AVG-WHSSM. |
| 03EF | F5 | | PUSH | PSW | |
| 03F0 | 0A | | LDAX | B | |
| 03F1 | F644 | | ORI | FWHBSB+FWHBDV | ;DIVERT SHORT BILL. |
| 03F3 | 02 | | STAX | B | |
| 03F4 | F1 | | POP | PSW | |
| 03F5 | | FWFC03: | | | |
| 03F5 | D602 | | SUI | FWTSSM | ;RESTORE BILL LENGTH. |

FIG. 16B

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 03F7 | 96 | | SUB | M | |
| 03F8 | C41D04 | | CNZ | FWFC05 | ;UPDATE BILL AVERAGE. |
| 03FB | 0A | | LDAX | B | ;BILL STATUS. |
| 03FC | 67 | | MOV | H,A | |
| 03FD | 0B | | DCX | B | |
| 03FE | 0B | | DCX | B | |
| 03FF | 0A | | LDAX | B | ;XPORT STATUS. |
| 0400 | B4 | | ORA | H | |
| 0401 | E640 | | ANI | FWHBDV | ;ARE EITHER XPORT OR BILL DIVERTING. |
| 0403 | 0F | | RRC | | |
| 0404 | 6F | | MOV | L,A | ;DVT. POS. BIT SET IN REG. L. |
| 0405 | 0A | | LDAX | B | ;XPORT STATUS. |
| 0406 | E6DF | | ANI | NOT FWHDVP | ;CLEAR OLD DVT. POS. BIT. |
| 0408 | B5 | | ORA | L | ;SET/CLEAR NEW DVT POS BIT. |
| 0409 | 02 | | STAX | B | |
| 040A | E640 | | ANI | FWHBDV | |
| 040C | B4 | | ORA | H | |
| 040D | 03 | | INX | B | |
| 040E | 03 | | INX | B | |
| 040F | 02 | | STAX | B | ;SET BILL DIVERT IF XPORT DIVERTING. |
| 0410 | E640 | | ANI | FWHBDV | |
| 0412 | 3EA0 | | MVI | A,FWPFCB+FWPMCB | ;ENERGIZE DIVERTED. |
| 0414 | CA1904 | | JZ | FWFC04 | ;JMP IF BILL TO BE DISPENSED. |
| 0417 | 3E41 | | MVI | A,FWPDCB+FWPFSB | ;RELAX DIVERTER |
| 0419 | | FWFC04: | | | |
| 0419 | CDE406 | | CALL | FWIOMC | |
| 041C | C9 | | RET | | |
| | | ;UPDATE BILL AVERAGE. | | | |
| 041D | | FWFC05: | | | |
| 041D | F22504 | | JP | FWFC06 | ;JMP IF DIFF POSITIVE. |
| 0420 | FEFF | | CPI | OFFH | |
| 0422 | C8 | | RZ | | ;RETURN IF DIFF EQUALS -1. |
| 0423 | 35 | | DCR | M | ;DCR AVG IF DIFF LESS THAN -1. |
| 0424 | C9 | | RET | | |
| 0425 | | FWFC06: | | | |
| 0425 | FE01 | | CPI | 1 | |
| 0427 | C8 | | RZ | | ;RETURN IF DIFF EQUALS 1. |
| 0428 | 34 | | INR | M | ;INC AVG IF DIFF GREATER THAN 1. |
| 0429 | C9 | | RET | | |

FIG. 17A

VERIFY DIVERTER POSITION

```
MEMORY   MACHINE
LOCATION EXECUTABLE   SYMBOLIC  OPERATIONAL
         INSTRUCTIONS  LABELS     CODES      OPERANDS    DESCRIPTION

                      ;ON ENTRY:              BC = BILL STATUS ADDR.
                      ;                       DE = ZHLIA.
                      ;ON RETURN:             BC, DE SAVED.
042A                  FWDCØØ:
042A     210600                   LXI        H,FWHNXT    ;CLEAR NEXT BILLS
                                                          INITIAL STATUS.
042D     19                       DAD        D           ;IF IT HAS BEEN USED
                                                          BY NOW, THEN
042E     3600                     MVI        M,0         ;IT DOESN'T APPLY
                                                          TO BILL AFTER
                                                          NEXT.
0430     0A                       LDAX       B           ;BILL STATUS.
0431     E640                     ANI        FWHBDV
0433     C24404                   JNZ        FWDC01      ;JMP IF DIVERTING.
0436     212100                   LXI        H,FWHIOS+6  ;FREJECT FSENSOR
                                                          FHISTORY.
0439     19                       DAD        D
043A     7E                       MOV        A,M
043B     E601                     ANI        01H
043D     210528                   LXI        H,(FWSHWM+FWSNOP)*256+FWADCD
0440     CCFC04                   CZ         FWSTMS      ;SET STATUS, IF NOT
                                                          IN DISPENSE
                                                          POSITION.
0443     C9                       RET
0444                  FWDC01:
0444     03                       INX        B
0445     03                       INX        B
0446     0A                       LDAX       B           ;PREVIOUS BILL'S
                                                          STATUS
0447     0B                       DCX        B
0448     0B                       DCX        B
0449     E6C0                     ANI        FWHBDV+FWHBPN
044B     FEC0                     CPI        FWHBDV+FWHBPN
044D     CA6004                   JZ         FWDC02      ;JMP IF PREV BILL
                                                          DIVERTED.
0450     212100                   LXI        H,FWHIOS+6  ;REJECT SENSOR
                                                          HISTORY.
0453     19                       DAD        D
0454     7E                       MOV        A,M         ;THIS IS THE FIRST
                                                          BILL TO BE
                                                          DISPENSED.
0455     23                       INX        H
0456     3600                     MVI        M,0         ;CLEAR REJECT
                                                          DETECTION COUNTER,
                                                          FOR FIRST BILL.
0458     E601                     ANI        01H
045A     210628                   LXI        H,(FWSHWM+FWSNOP)*256+FWADCR
045D     C4FC04                   CNZ        FWSTMS      ;IF STILL DISPENSE
                                                          POS., SET HWM
                                                          STATUS.
0460                  FWDC02:
0460     210A00                   LXI        H,FWHDVT    ;DIVERT COUNT.
0463     19                       DAD        D
0464     7E                       MOV        A,M
0465     FE09                     CPI        FWTDLM-1    ;DIVERT LIMIT IN-
                                                          CLUDING CURRENT
                                                          BILL.
```

FIG. 17B

```
MEMORY    MACHINE
LOCATION  EXECUTABLE   SYMBOLIC  OPERATIONAL
          INSTRUCTIONS  LABELS     CODES      OPERANDS     DESCRIPTION

0467      210728                   LXI        H,(FWSHWM+FWSNOP)*256+FWADCL
046A      D4FC04                   CNC        FWSTMS       ;SET STATUS, IF
                                                             LIMIT EXCEEDED.
046D      C9                       RET
```

FIG. 18A

```
                                BILL UNDER EXIT OR REJECT SENSORS

                                ;ON ENTRY:                BC = BILL STATUS.
                                ;                         DE = ZHLIA.
                                ;ON RETURN:               BC, DE SAVED.
046E                            FWXUØØ:
046E      0A                             LDAX       B            ;BILL STATUS.
046F      F620                           ORI        FWHBXU       ;SET BILL UNDER
                                                                   XIT OR REJ SENSOR
                                                                   BIT.
0471      02                             STAX       B
0472      E640                           ANI        FWHBDV
0474      C29204                         JNZ        FWXU01       ;JMP IF DIVERTING.
0477      212000                         LXI        H,FWHIOS+5   ;EXIT FSENSOR
                                                                   FCOUNT.
047A      19                             DAD        D
047B      7E                             MOV        A,M
047C      FE03                           CPI        FWTCXJ       ;BILL MUST HAVE
                                                                   BEEN SEEN AT
                                                                   LEAST CXJ TIMES.
047E      21080C                         LXI        H,(FWSBJT+FWSNOP)*256+FWAXUX
0481      DCFC04                         CC         FWSTMS       ;IF NOT SEEN CXJ
                                                                   TIMES, JAM.
0484      210900                         LXI        H,FWHSUM
0487      19                             DAD        D
0488      7E                             MOV        A,M
0489      3C                             INR        A
048A      2B                             DCX        H
048B      BE                             CMP        M            ;IF THIS IS THE
                                                                   LAST BILL,
048C      3EE0                           MVI        A,FWPFDM     ;SHUT EVERYTHING
                                                                   OFF.
048E      CCB106                         CZ         FWIODO
0491      C9                             RET
0492                            FWXU01:
0492      212200                         LXI        H,FWHIOS+7   ;REJECT SENSOR
                                                                   COUNT.
0495      19                             DAD        D
0496      7E                             MOV        A,M
0497      FE03                           CPI        FWTCXJ       ;BILL MUST BE SEEN
                                                                   CXJ TIMES.
0499      21090C                         LXI        H,(FWSBJT+FWSNOP)*256+FWAXUR
049C      DCFC04                         CC         FWSTMS       ;CALL IF BILL NOT
                                                                   SEEN.
049F      210B00                         LXI        H,FWHAUX
04A2      19                             DAD        D
04A3      7E                             MOV        A,M
04A4      FE0B                           CPI        FWAXCX       ;NO POINT IN
                                                                   CHECKING EXIT IF
04A6      C8                             RZ                      ;PREVIOUS DID NOT
                                                                   CLEAR EXIT.
```

FIG. 18B

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| 04A7 | 212000 | | LXI | H,FWHIOS+5 | |
| 04AA | 19 | | DAD | D | ;EXIT SENSOR COUNT. |
| 04AB | 7E | | MOV | A,M | |
| 04AC | FE02 | | CPI | FWTCRJ | |
| 04AE | 210A28 | | LXI | H,(FWSHWM+FWSNOP)*256+FWAXUS | |
| 04B1 | D4FC04 | | CNC | FWSTMS | ;SET STATUS IF EXIT NOT CLEAR. |
| 04B4 | D8 | | RC | | ;RET, IF BILL NOT UNDER EXIT SENSOR. |
| 04B5 | 0A | | LDAX | B | ;CLEAR DIVERT BIT, SO BILL WILL BE |
| 04B6 | E6BF | | ANI | NOT FWHBDV | ;COUNTED BY EXIT CLEAR ROUTINE. |
| 04B8 | 02 | | STAX | B | |
| 04B9 | C9 | | RET | | |

FIG. 19

BILL CLEAR OF EXIT OR REJECT SENSORS

| | | | | | |
|---|---|---|---|---|---|
| | | ;ON ENTRY: | | BC = BILL STATUS. | |
| | | ; | | DE = ZHLIA. | |
| | | ;ON RETURN: | | BC, DE SAVED. | |
| 04BA | | FWXCØØ: | | | |
| 04BA | 0A | | LDAX | B | |
| 04BB | E601 | | ANI | FWHBOL | ;IF BILL IS OVER-LENGTH. |
| 04BD | C0 | | RNZ | | ;RETURN AND CHECK NOTHING. |
| 04BE | 0A | | LDAX | B | |
| 04BF | E640 | | ANI | FWHBDV | |
| 04C1 | C2D004 | | JNZ | FWXC01 | ;JMP IF DIVERTING. |
| 04C4 | 0A | | LDAX | B | |
| 04C5 | E620 | | ANI | FWHBXU | ;THIS BIT WAS CLEARED WHEN THE BILL CLEARED. |
| 04C7 | 210B0C | | LXI | H,(FWSBJT+FWSNOP)*256+FWAXCX | |
| 04CA | C4FC04 | | CNZ | FWSTMS | ;IF EXIT NOT CLEAR, SET JAM STATUS. |
| 04CD | C36B05 | | JMP | FWSTXC | ;PERFORM XPORT CLEAR HOUSE KEEPING. |
| 04D0 | | FWXC01: | | | |
| 04D0 | 211100 | | LXI | H,FWHSTT | |
| 04D3 | 19 | | DAD | D | |
| 04D4 | 7E | | MOV | A,M | |
| 04D5 | E620 | | ANI | FWHDVP | |
| 04D7 | CA6B05 | | JZ | FWSTXC | ;JMP IF GATE IN DISPENSE POSITION. |
| 04DA | 0A | | LDAX | B | |
| 04DB | E620 | | ANI | FWHBXU | ;THIS BIT WAS CLEARED WHEN THE BILL CLEARED. |
| 04DD | 210C0C | | LXI | H,(FWSBJT+FWSNOP)*256+FWAXCR | |
| 04E0 | C4FC04 | | CNZ | FWSTMS | ;CALL IF BILL NOT CLEAR, JAM STATUS. |
| 04E3 | C36B05 | | JMP | FWSTXC | ;PERFORM XPORT CLEAR HOUSE KEEPING. |

FIG. 20

OVERLENGTH BILL CLEAR OF REJECT SENSOR

| MEMORY LOCATION | MACHINE EXECUTABLE INSTRUCTIONS | SYMBOLIC LABELS | OPERATIONAL CODES | OPERANDS | DESCRIPTION |
|---|---|---|---|---|---|
| | | ;ON ENTRY: | | BC = BILL STATUS. | |
| | | ; | | DE = ZHLIA. | |
| | | ;ON RETURN: | | BC, DE SAVED. | |
| 04E6 | | FWROØØ: | | | |
| 04E6 | 211100 | | LXI | H,FWHSTT | |
| 04E9 | 19 | | DAD | D | |
| 04EA | 7E | | MOV | A,M | |
| 04EB | E620 | | ANI | FWHDVP | |
| 04ED | CA6B05 | | JZ | FWSTXC | ;JMP IF GATE IN DISPENSE POSITION. |
| 04F0 | 0A | | LDAX | B | |
| 04F1 | E620 | | ANI | FWHBXU | |
| 04F3 | 210E0C | | LXI | H,(FWSBJT+FWSNOP)*256+FWAROR | |
| 04F6 | C4FC04 | | CNZ | FWSTMS | ;CALL IF BILL DID NOT CLEAR REJ SENSOR. |
| 04F9 | C36B05 | | JMP | FWSTXC | ;XPORT CLEAR HOUSE KEEPING. |

GLOSSARY OF ACRONYMS

| | |
|---|---|
| ;ZHLIA | HI/LO SECTION INDEX ADDR. |
| ;ZCSIA | COMMON SECTION INDEX ADDR. |
| ;ZRJHC | RIGHT JUSTIFIED FOR HISTORY BYTE COMPARISON AND 1 BITS MUST BE CONTIGUOUS. EACH BIT REPRESENTS ONE SCAN PERIOD. |
| ;ZCNBC;L1 | INDICATES THE LABEL CAN NOT BE CHANGED RELATIVE TO L1. |
| ;ZCNBC | INDICATES THE VALUE DEFINED CAN NOT BE CHANGED WITHOUT A CORRESPONDING CHANGE IN THE CODING. |
| ;ZSTS | SLOWEST TRANSPORT SPEED. |
| ;ZFTS | FASTEST TRANSPORT SPEED. |

FIG. 21

DOCUMENT DISPENSING SYSTEM

BACKGROUND OF THE INVENTION

This invention relates to a document dispensing system including a method of dispensing documents such as currency or bills in a transaction execution terminal.

Transaction execution terminals are currently available for the performance of specific financial transactions. Such terminals typically require the insertion of a credit card containing account information written on a magnetic stripe and the keyboard entry of a personal ID number which corresponds in a predetermined manner to the credit card account information. The terminal then receives the requested "dollar amount" through the numeric keyboard and issues the desired amount of cash if the credit card and the ID number are found to be in order. One such system is shown in U.S. Pat. No. 3,937,925 which issued on Feb. 10, 1976.

One problem associated with such transaction execution terminals is that the document or bill dispensing system associated with the terminal is generally expensive to manufacture. Also, generally only one bill at a time may be present in the bill dispensing system which makes the total time for dispensing a large number of bills time-consuming.

Another problem associated with the document dispensing systems is that the control means used therewith are generally not flexible enough to handle a variety of currencies from different countries.

SUMMARY OF THE INVENTION

This invention relates to a method and system for dispensing documents. In a preferred embodiment, the system includes a dispensing path and means for feeding documents such as currency or bills from a source to and along the dispensing path. A diverter means which is located in the dispensing path is used to dispense the documents in the dispensing path into either a reject bin or a customer access receptacle. Sensors positioned along the dispensing path are used to detect the presence or absence of documents in the dispensing path, and the system also includes means for sampling the sensors to produce first and second states therein in accordance with the presence or absence, respectively, of documents in the dispensing path. First means are used for storing the first and second states to provide short-term and long-term histories of the states of each of the sensors, and a second means for storing status data, including a time in transport in the dispensing path for each of the documents in the dispensing path is also included. Means are also included for utilizing the short and long term histories of the states of the sensors and the time in transport for evaluating the status of each of the documents in the dispensing path with regard to predetermined criteria to produce a control signal which controls the disposition of each document into the customer access receptacle or the reject bin.

This invention enables more than one document to be present in the dispensing path at any one time and provides a flexible, low-cost, accurate control on the documents being dispensed in the system.

These advantages and others will be more readily understood in connection with the following specification, claims, and drawing.

BRIEF DESCRIPTION OF THE DRAWING

FIG. 4 shows an "Input/Output Sensor Status Table No. 1" for storing the various states of the sensors shown in FIG. 1 to provide short-term and long-term histories of the states of the sensors;

FIG. 5 shows a "Bill Status Table No. 2" related to the various documents or bills which may be present in the dispensing path shown in FIG. 1;

FIG. 6 shows a "Bill Progress Table No. 3" which is utilized to check on the progress of the bills at various check points in the dispensing path;

FIG. 9 is a flow chart showing a "Determine Whether A Bill Requires A Progress Check" routine associated with the control means shown in FIG. 2;

FIG. 10 shows a detail program listing of the "Read State of Sensors" routine shown in FIG. 7;

FIGS. 11A and 11B show a detail program listing of the "Determine Whether A Bill Requires A Progress" routine shown in FIG. 8;

FIG. 12 shows a detail program listing for the check points shown in Table No. 3 shown in FIG. 6;

FIG. 13 shows a detail program listing of various bill status codes used in Table No. 2;

FIGS. 14A and 14B show a detail program listing of various Timing Definitions used in conjunction with FIGS. 8 and 11;

FIG. 15 shows a detail program listing of a routine associated with Check Point 1 in FIG. 6;

FIGS. 16A and 16B show a detail program listing of a routine associated with Check Point 2 in FIG. 6;

FIGS. 17A and 17B show a detail program listing of a routine associated with Check Point 3 in FIG. 6;

FIGS. 18A and 18B show a detail program listing of a routine associated with Check Point 4 in FIG. 6;

FIG. 19 shows a detail program listing of a routine associated with Check Point 5 in FIG. 6;

FIG. 20 shows a detail program listing of a routine associated with Check Point 6 in FIG. 6; and FIG. 21 shows a glossary of acronyms used with various detail program listings herein.

A DETAILED DESCRIPTION OF THE INVENTION

Figure 1:
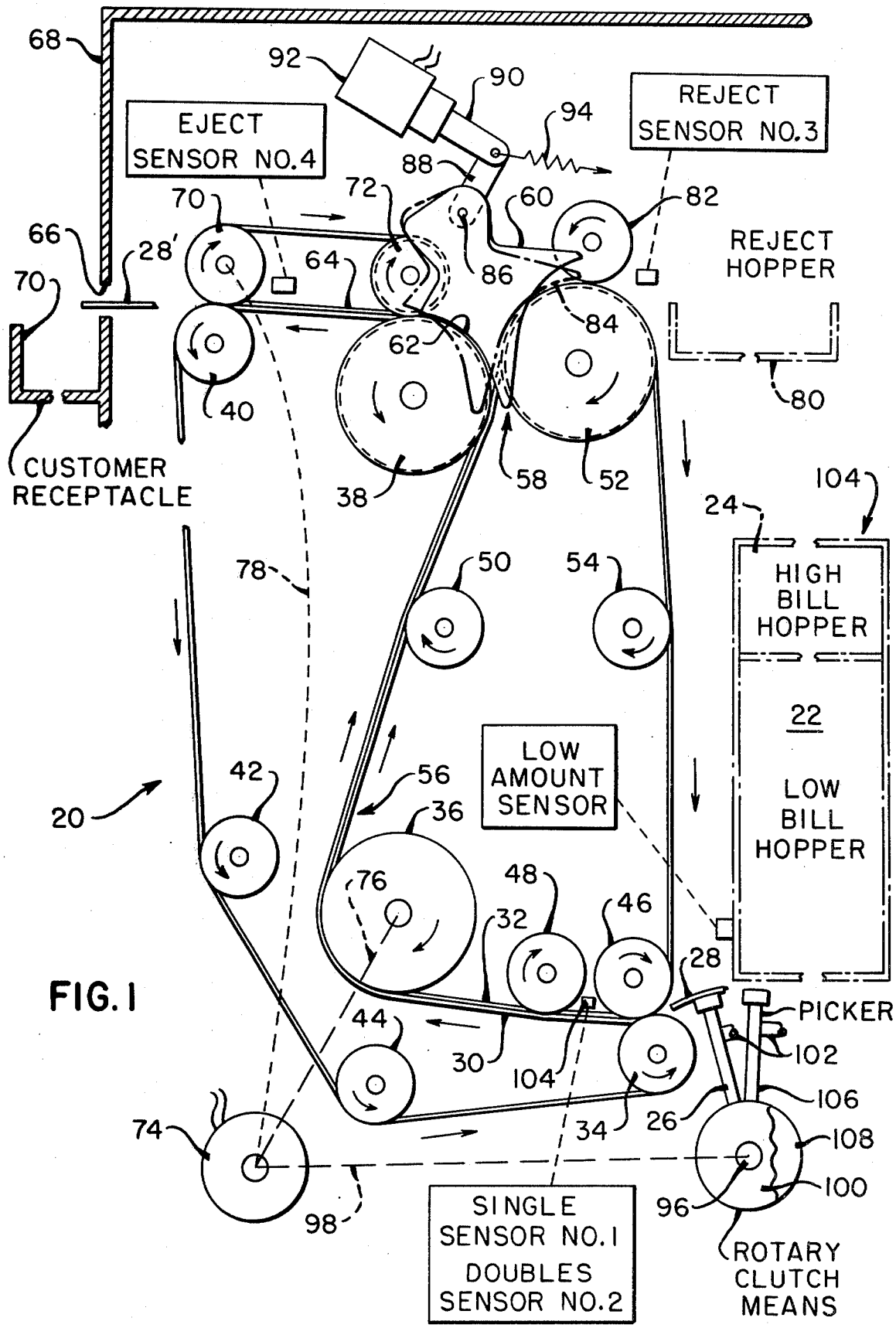
FIG. 1 is a schematic diagram of a document dispensing mechanism which may be used with this invention, showing a source of documents or bills, a dispensing path, means for feeding the documents from the source to and along the dispensing path, a reject hopper, a customer receptacle, sensors positioned along the dispensing path, and diverter means for diverting the documents in the dispensing path into either the reject hopper or the customer receptacle depending upon an evaluation of certain criteria about the documents passing through the dispensing mechanism.

FIG. 1 is a general schematic diagram of a document dispensing mechanism which may be used with this invention. The document dispensing mechanism which is designated generally as 20 includes a low bill hopper 22 and a high bill hopper 24 which hoppers are shown partially broken away in order to facilitate the showing thereof. Documents or bills such as five dollar bills in U.S. currency may be stored in the low bill hopper 22, and high bills such as a twenty dollar bill in U.S. currency may be stored in the hopper 24. As shown in FIG. 1, the length of the bills is positioned from left to right, and the width thereof is aligned perpendicular to the plane of the drawing of FIG. 1. The bills which are present in hopper 22 are picked from the lower side thereof by the picker 26, which may be any conventional picker mechanism. As a bill is picked from the lower side of the hopper 22, such as bill 28 shown only partially in FIG. 1, the bill 28 is fed between the belts 30 and 32. Belt 30, for example, is an endless type belt which is mounted on the pulleys 34, 36, 38, 40, 42, and 44 as shown. These pulleys 34 through 44 are supported on horizontally shafts to enable these pulleys to rotate thereon as is conventionally done. The belt 32 is similarly supported on pulleys 46, 48, 36, 50, 52, and 54. The belts 30 and 32 have teeth (not shown) thereon which are transversely located on each of the belts, and these belts engage the complementarily shaped pulleys already described in relation to FIG. 1 so as to provide a positive traction for driving the belts 30 and 32.

The bill 28, for example, which was just picked off the lower side of hopper 22, is fed between the belts 30 and 32 which form a dispensing path designated generally as 56. As the bill 28 is moved along the dispensing path by the belts 30 and 32, the bill 28 approaches a diverter means designated generally as 58. The diverter means 58 includes a diverter 60 which is shown in a first position in solid outline in FIG. 1 which enables the bill approaching the diverter means 58 to be diverted by the curved surface 62 of the diverter 60, causing that particular bill to be moved between the endless belt 30 and a third endless belt 64 and to be output through an opening 66 in the protective cabinet 68 to thereby enable the bill shown as 28′ to be dispensed into a customer receptacle 70 which may be accessed by a customer from the exterior of the protective cabinet 68.

The endless belt 64 is similar in construction to the endless belts 30 and 32 already described; however, the belt 64 is mounted on pulleys 70 and 72. The means for driving the belts 30 and 32 include a motor 74 and a conventional interconnecting means shown only as a dashed line 76. Similarly, a conventional interconnecting means 78 is used to drivingly interconnect the pulley 70 with the driving motor 74. Because these aspects may be conventional, they need not be described in any further detail.

If for one reason or another, the bill 28 shown in FIG. 1 is to be rejected and placed in the reject hopper 80, the diverter 60 will be positioned in the reject position shown by a dashed outline shown in FIG. 1. When in this reject position, the curved surface 84 of the diverter 60 will cause the bill approaching the diverter means 58 to be passed between the endless belt 32 and the pincher roller 82 causing the bill to fall into the reject hopper 80 which is located inside the protective cabinet 68 and which is inaccessible to a customer.

The diverter 60 has fixed thereto a shaft 86 which is rotatably supported within the protective cabinet 68 and which shaft also has one end of link 88 fixed thereto, and the remaining end of link 88 is pivotally joined to the operating plunger 90 of the solenoid 92. One end of a spring 94 is operatively connected to one end of link 88 as shown, and the remaining end thereof is connected to a fixed point so as to enable the diverter means 58 to channel a bill into the reject hopper whenever the solenoid 92 is deenergized. Energizing the solenoid 92 causes the diverter means 58 to eject a bill into the customer receptacle 70.

The motor 74 is operatively connected to a conventional rotary drive line 96 by a conventional interconnecting means 98 shown only as a dashed line in FIG. 1. As the motor 74 rotates, it causes the drive line 96 to rotate therewith. A conventional rotary clutch means 100 is mounted on the drive line 96 so as to be actuated thereby whenever the rotary clutch means 100 is to be energized. When a bill 28 is to be picked off the bottom side of the bill hopper 22, for example, the rotary clutch means 100 will be energized causing the picker 26 to pick the lowermost bill from the hopper 22 as already described. The picker 26 has a source vacuum shown as a tube 102 connected thereto to facilitate the picking of the bill 28 from the hopper 22. Because the picker 26, drive line 96 and rotary clutch means 100 may all be conventional, they need not be described in any further detail herein.

In order to check on the progress of a bill such as 28 shown in FIG. 1 as it progresses through the dispensing path 56, there are certain sensors positioned along the dispensing path in order to check on the progress of the bill as it moves through the dispensing mechanism 20. These sensors include, in the embodiment being described, a single sensor number 1 and a doubles sensor number 2, which are combined in a single unit 104 which is located at the entrance of the dispensing path 56 adjacent to the bill hopper 22. In the embodiment being described, the sensors number 1 and number 2 are conventional photoelectric sensors which are used to detect the presence or absence of bills within the dispensing path 56. The sensor number 1 detects the presence of one or more bills as it approaches the dispensing path 56, and the sensor number 2 is utilized to detect those situations in which two or more bills may be together or overlapping as they are picked from the hopper 22 by the picker 26. A reject sensor number 3 is positioned adjacent to the entrance of the reject hopper 80 so as to detect the presence of a bill being rejected into this hopper. Similarly, an eject sensor number 4 is positioned near the opening 66 in the protective cabinet 68 so as to be able to detect the presence of a bill such as bill 28′ being dispensed into the customer receptacle 70. Reject sensor number 3 and eject sensor number 4 are conventional photoelectric or contact sensors which are used to detect the presence ior absence of a bill in their respective areas.

What has been described so far in relation to FIG. 1 relates to the dispensing mechanism 20 for dispensing low-denomination bills from hopper 22. As is customary with cash dispensing mechanisms, provision is made for dispensing bills of a higher denomination. The dispensing mechanism for dispensing bills from the high bill hopper 24 is identical to that already described therefore, a complete description of all the elements included in the dispensing mechanism designated as 104 is not deemed necessary. The dispensing mechanism 104 for dispensing the bills from hopper 24 includes a separate picker 106 which is driven by a separate rotary clutch means 108 as shown in FIG. 1. When the rotary clutch means 108 is energized, the picker 106 will pick the lowermost bill from the high bill hopper 24 and transfer the bill so picked into a dispensing path 110 which is identical to the dispensing path 56 already described; however, the dispensing path 110 is not shown in FIG. 1. The dispensing mechanism 104 is located behind the dispensing mechanism 20 shown in FIG. 1. The dispensing mechanism 104 would have its own diverter means (similar to diverter means 58) associated therewith and it would also have the sensors number 1 throgh 4 located at the same points along the associated dispensing path 110.

Figure 2:
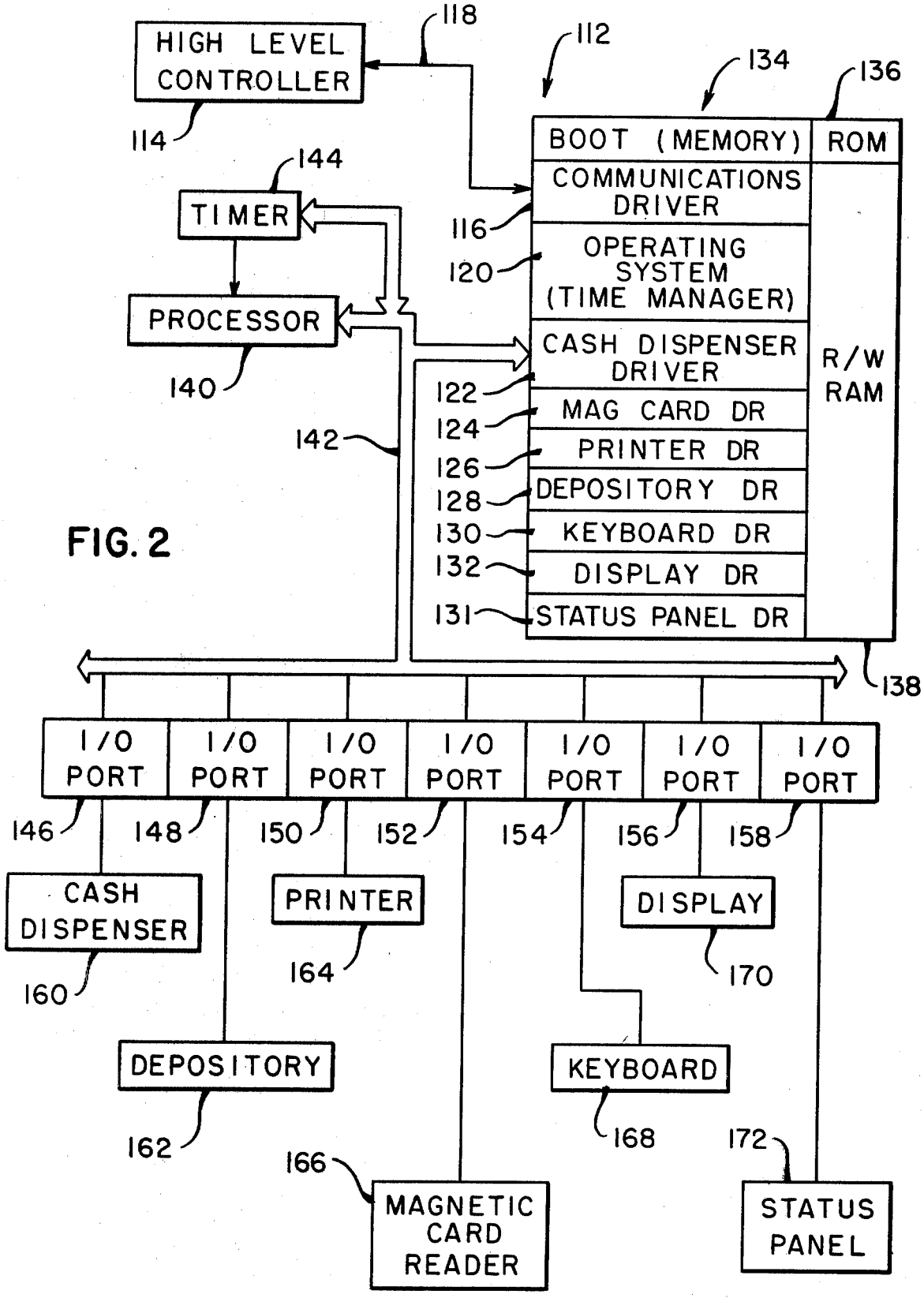
FIG. 2 is a general schematic diagram in block form of a control means which may be used with this invention.

FIG. 2 is a general schematic diagram in block form of a control means 112 which may be used with this invention. The control means 112 includes a high level controller 114 which is connected to a communications driver 116 via a conventional four wire serial transmission line 118. The control means 112 also includes an operating system including a conventional time manager shown in block 120 of FIG. 2. The control means 112 also includes the cash dispenser driver 122, the magnetic card driver 124, the printer driver 126, the depository driver 128, the keyboard driver 130, the status panel driver 131 and the display driver 132. All the drivers mentioned are a part of a conventional memory designated generally as 134, and this memory also includes a conventional ROM unit 136, and a conventional read/write RAM memory 138. The various drivers included in the memory 134 are interconnected to a general microprocessor 140 via a conventional tri-state bus 142 as shown in FIG. 2. A conventional timer 144 such as integrated circuit chip #8253 (manufactured by Intel) is also connected to the tri-state bus 142 and the processor 140.

The various drivers shown in memory 134 in FIG. 2 are connected to their associated hardware elements by a plurality of I/O ports 146 through 158 as shown. For example, the dispensing mechanism 20 shown in FIG. 1 is represented on FIG. 2 by the block 160. The dispensing mechanism 20 is connected via the I/O port 146 and the tri-state bus 142 to the cash dispenser driver 122 as is conventionally done.

The transaction execution terminal with which this invention may be used is not shown in the drawing; however, the various elements associated with such a terminal are shown in block form in FIG. 2. These elements include a depository 162, a printer 164, a magnetic card reader 166, a keyboard 168, and a display 170. Because these elements are conventional, they need not be described in any further detail other than to say that the depository 162, for example, is utilized to receive deposits by a user of the transaction execution terminal. The method of using the transaction execution terminal is also conventional and need not be described in elaborate detail herein. The status panel 172 shown in FIG. 2, is connected through the I/O port 158, through the status panel driver 131, through the operating system 120, and through the communications driver 116 to the high level controller 114 to indicate the status of the cash dispenser driver (too few bills in hoppers 22, 24, etc.) to a monitoring center which may be located in a bank and monitored by bank personnel.

Figure 3:
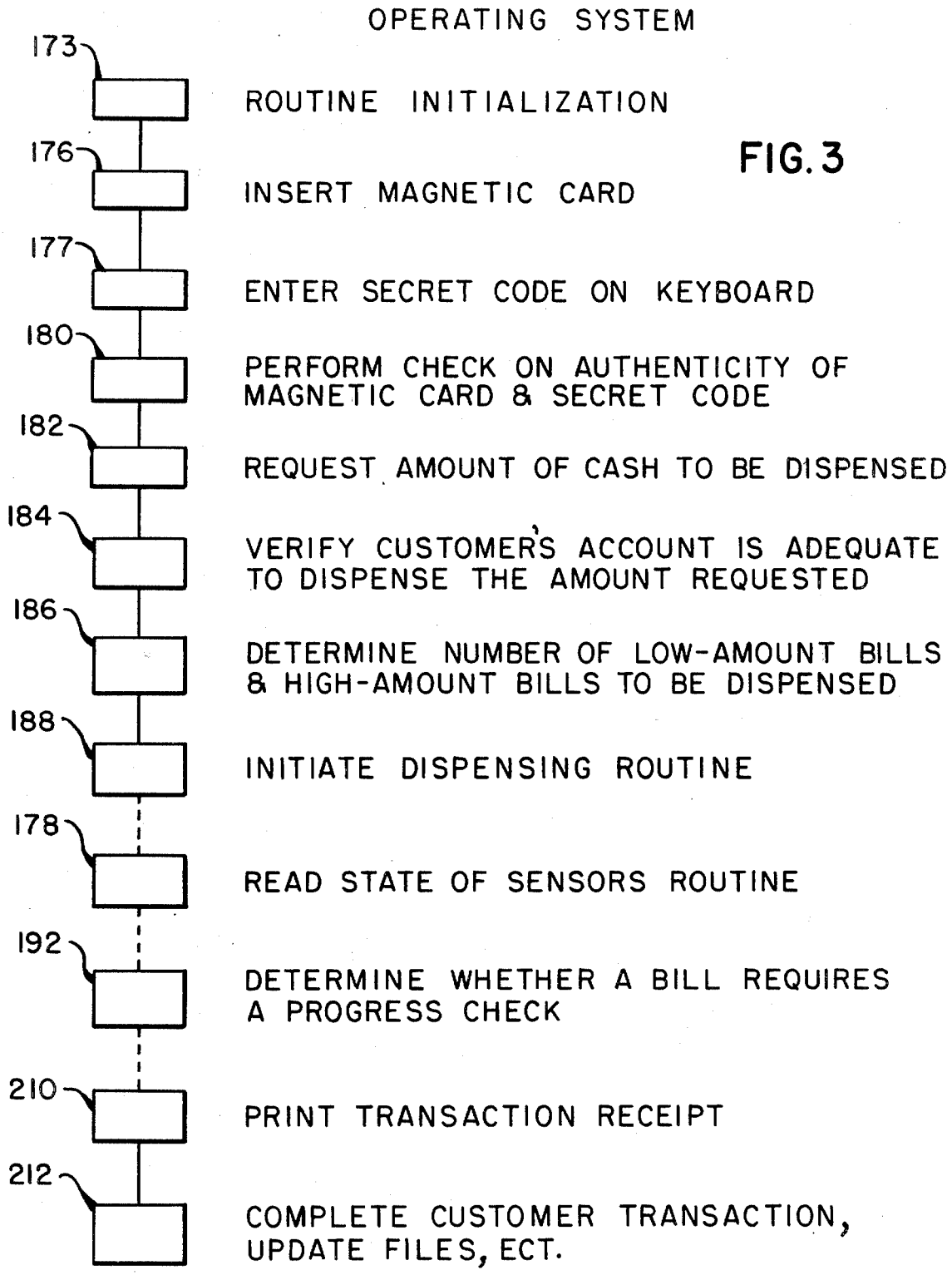
FIG. 3 is a general flow chart showing various operational steps associated with the control means shown in FIG. 2.

Before proceeding with a detailed discussion of the document dispensing system of this invention, it would appear appropriate to discuss the general functioning of a transaction execution terminal in which this invention may be incorporated. In this regard, FIG. 3 shows an operating system which performs several routine operations in preparation for effecting a cash dispensing function. The high level controller 114 shown in FIG. 2, performs the routine initialization shown at step 173 on FIG. 3. After this routine initialization is completed, a user of the transaction execution terminal is requested by the display 170 to insert his magnetic card into the magnetic card reader 166 shown in FIG. 2 and also shown as step 175 in FIG. 3. At step 177, the user enters on the keyboard 168 a secret code peculiar only to him. The operating system 120 controlled by the high level controller 114 then performs at step 180 a check on the authenticity of the magnetic card and the secret code entered by the user. Assuming that the magnetic card and the secret code are authentic, the display 170 requests the amount of cash which the customer wishes to receive; this is shown at step 182. At step 184, a controller 114 then verifies the user's account to ascertain that there is a sufficient balance therein to enable the user to be dispensed the amount of cash which was requested. At step 186 the operating system under the control of the high level controller 114 then determines the number of low amount bills and high amount bills which are to be dispensed for the amount requested by the user. At step 188, the dispensing routine is initiated.

The cash dispensing routine is under the control of the cash dispenser driver 122 shown in FIG. 2. It should be noted at this time that there are duplicate sections in the driver 122 for the low amount bills and the high amount bills; however, the discussion will proceed with only the functions as they relate to the low amount bills.

Figure 7:
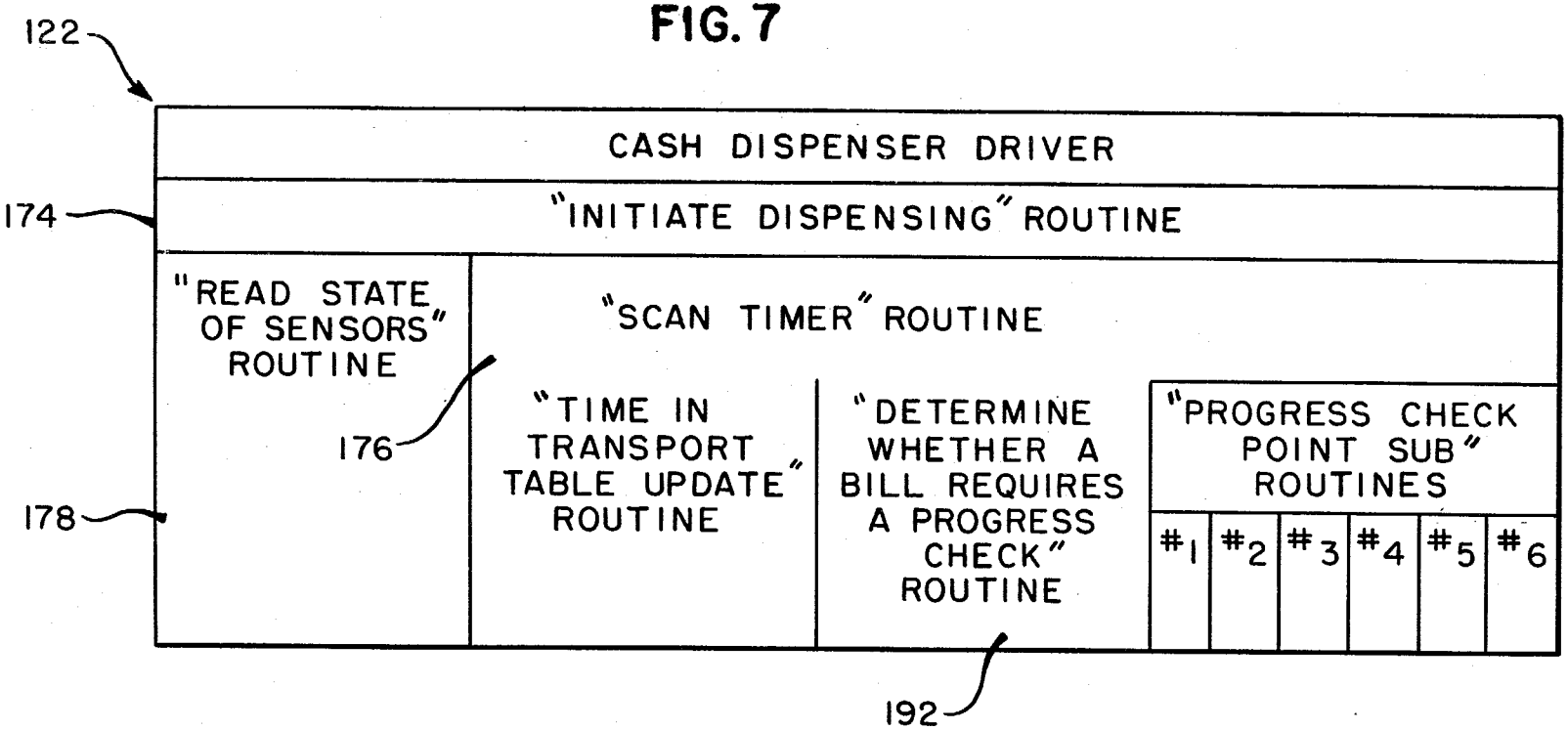
FIG. 7 is a chart showing how the cash dispensing driver shown in FIG. 1 is further divided into its component routines.

The cash dispenser driver 122 shown in FIG. 2, is shown in expanded form in the chart shown in FIG. 7 so as to indicate the various subroutines which are included in the cash dispenser driver 122.

One of the first routines which is initiated by the cash dispenser driver 122 shown in FIG. 7, is the Initiate Dispensing Routine 174. This Routine 174 performs general housekeeping functions, such as starting the motor 74 shown in FIG. 1 and clearing various counters to be described later herein. The Initiate Dispensing Routine 174 also causes the time manager shown in the operating system 120 of FIG. 2 to initiate the Scan Timer Routine 176 shown in FIG. 7. The Routine 176 gains control from the timer manager every ten milliseconds to perform its routine in the embodiment being described. The Scan Timer Routine 176 also initiates the Read State Of Sensors Routine 178 which reads the states of the Sensors Numbers 1 through 4 which are shown in FIG. 1.

Before proceeding with a discussion of the Read State Of Sensors Routine 178, it would be useful to discuss how the reading or polling of the sensors is accomplished. Each of the Sensors Numbers 1 through 4 shown on FIG. 1 is read every ten milliseconds in the embodiment being described. The various states of the sensors are recorded in an Input/Output Sensor Status Table Number 1 shown in FIG. 4. For each of the Sensors Numbers 1 through number 4, there is stored a Short-Term History and a Long-Term History. The Short-Term History consists of an 8-bit byte. If, for example, the first time that the Single Sensor Number 1 is read or polled and a bill such as 28 in FIG. 1 is located thereunder, a binary 1 will be recorded in the Short-Term History. If no bill 28 is present under the Single Sensor Number 1, a binary 0 will be recorded in the Short-Term History. In the embodiment being described, this Short-Term History is stored in an 8-bit shift register, and a suitable section in memory 138. For each polling of Sensor Number 1, the most recent binary bit derived from Sensor Number 1 is fed into the rightmost position of the Short-Term History. Thus, the most recent 8 statuses of the Sensor Number 1 will be recorded under the Short-Term History with the most recent state of the Sensor Number 1 being located in the rightmost bit in the Table Number 1. This same technique is used for the Doubles Sensor Number 2, the Exit Sensor Number 3, and the Reject Sensor Number 4.

Each time that a bill such as 28 in FIG. 1 is present under the Single Sensor Number 1, for example, when that particular sensor is polled, a binary count of 1 will be added to a counter which comprises the Long-Term History shown in Table Number 1. When there is no bill such as 28 under the Sensor Number 1, a 0 is added to the counter which comprises the Long-Term History. Because the bill such as 28 travels at a constant rate through the dispensing path 56 shown in FIG. 1, the Long-Term History count shown in Table Number 1 can be used as a measure of the length of the bill passing under the Single Sensor Number 1. When a bill progress check is made on the specific bill such as 28 in the dispensing path 56, a bill which has too high a count probably indicates that there are overlapping bills within the dispensing mechanism, and these particular overlapping bills should be diverted into the reject hopper 80 shown in FIG. 1.

FIG. 5 shows a Bill Status Table Number 2 which has entries for Bills Numbers 1 through 4 which may be present in the dispensing path 56 in the embodiment being described. The time in transport (BT) shown in one of the columns in Table Number 2 represents the actual time that a particular bill is within the dispensing path 56. The second column shown in Table Number 2 relates to the status of each of the bills. There is an 8-bit byte which is provided for each of the bills within the dispensing path 56 to record various states or conditions relative to that particular bill. For example, if it were earlier determined that a particular bill 28 were too long, thereby indicating the overlapping of bills, an eight bit status such as 0000 0001 would be placed in one of the entries (like Bill No. 1 in Table No. 2) to indicate that this particular bill or bills should be diverted into the reject hopper 80; this entry corresponds to Operand 01H (written in Hex code) listed on the line corresponding to Memory Location 0001 shown in FIG. 13. The Time In Transport and the status of each bill are recorded for each of the bills such as Bills Numbers 1 through 4 in the dispensing path 56. While Bill Number 4 is shown as an entry on the Table Number 2, generally only three bills are handled within the dispensing path 56 for the embodiment being described. Naturally, the number of bills in the dispensing path 56 could be changed by increasing or decreasing the length of the dispensing path 56 so as to accommodate the usual anticipated number of bills to be handled by the dispensing mechanism 20. The Bill Status Table Number 2 is stored in a portion of the RAM memory 138 shown in FIG. 2.

FIG. 6 shows a Bill Progress Table Number 3 which is utilized to check on the progress of each of the bills as it travels through the dispensing path 56. In the embodiment being described, there are six checkpoints corresponding to locations on the path of bill movement which are used to check on the progress of the bills 28 within the dispensing mechanism 20. The first column in Table Number 3 entitled "Progress Count" (BP) relates to binary counts which are correlated to the progress of the bills 28 as they progress through the dispensing mechanism 20. For example, the first Checkpoint 1 would have a progress count of 00000111 which would indicate that this particular checkpoint is a predetermined point in the path of bill movement which is close to the Single Sensor Number 1 shown in FIG. 1. The progress counts are compared with the actual time in transport shown in Table Number 2 in order to check on the progress of the bills 28 as they progress through the dispensing mechanism 20.

Associated with each of the Checkpoints 1 through 6 shown in Table Number 3, is an address of a routine which is utilized to check on the progress of the bill. A detailed program listing of the routines associated with the addresses shown in Table Number 3 is shown in the Bill Progress Check Routines shown in FIG. 12. For example, from Table Number 3, the address of the routine for Checkpoint Number 1 is FWFUOO, which is listed under the column "Operands" in FIG. 12. Check point Number 1 is used as a check on the "Bill Under First Sensor" routine. A discussion of the Checkpoint Numbers 1 through 6 shown in Table Number 3 will be provided later herein.

Figure 8:
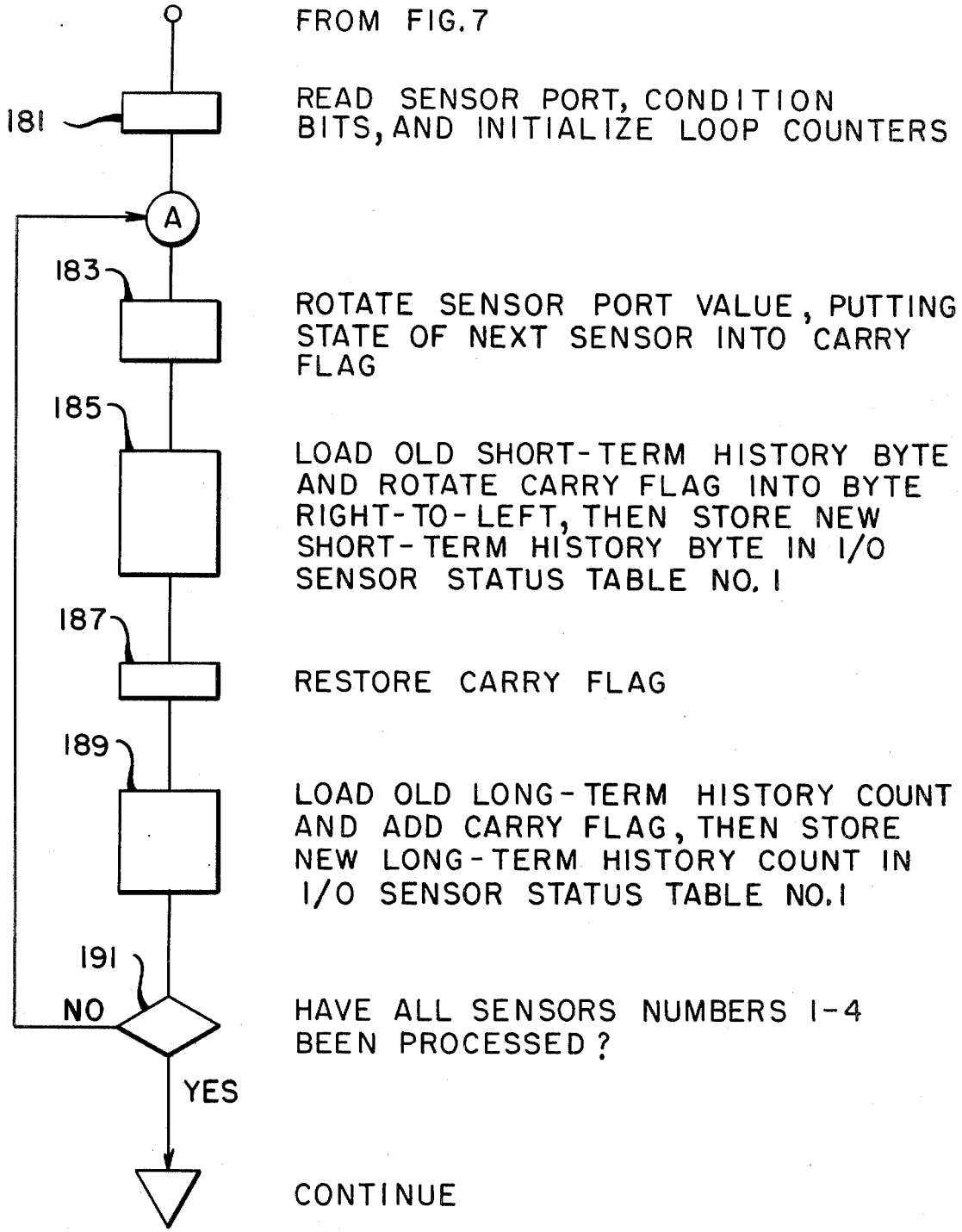
FIG. 8 is a flow chart showing a "Read State of Sensors" routine which is associated with the control means shown in FIG. 2.

The Initiate Dispensing Routine 174 (FIG. 7) initiates the Read State of Sensor Routine 178 which is shown in detail on FIG. 8. The Routine 178 performs the function of updating the Short-Term and Long-Term Histories shown in Table Number 1 in FIG. 4. The first step 181 in the Routine 178 shown in FIG. 8 is to read a sensor port and condition the various bits and initialize the loop counters associated therewith. Each of the states of the Sensors Numbers 1 through 4 is read at the same time in step 181. At step 183, the sensor port value is rotated, putting the state of the next sensor into the carry flag. At step 185, the old Short-Term History byte is loaded and the carry flag is rotated into the byte right-to-left, then the new Short-Term History byte is recorded in the Table Number 1. The carry flag is restored in step 187. The old Long-Term History count and the carry flag from step 187 are added together, and then this combined count is stored in step 189 as a new Long-Term History count in Table Number 1. At step 191, the question, "Have all Sensors Numbers 1 through 4 been processed?" is ascertained. If the answer is no, the routine branches back to step A to repeat the process for updating the Sensors Numbers 2 through 4. If all of the sensors have been processed at step 191, the Routine 178 is finished and the control shifts back to the Scan Timer Routine 176 shown in FIG. 7. A detailed listing of the Read State of Sensors Routine 178 is shown in FIG. 10. In the embodiment being described, the microprocessor 140 shown in FIG. 2, and utilized with this invention, is an 8080 Intel microprocessor, although other equivalent processors may be used with the system. Accordingly, the various operational codes and machine executable instructions shown in FIG. 10 and the other figures showing detailed program listings are for the 8080 microprocessor. For a more detailed description of the various operational codes, operands and the like, reference may be had to the instruction book entitled, "8080 Microcomputer Systems Users Manual", which was published by Intel Manufacturing Company, in September, 1975.

The Scan Timer Routine 176 shown in FIG. 7 initiates the Routine 192, shown in FIG. 7 and entitled, "Determine Whether A Bill Requires A Progress Check Routine". This Routine 192 is shown as a flowchart in FIG. 9. The general purpose of this Routine 192 is to compare the time in transport shown in Table Number 2 to the various progress counts shown in Table Number 3 of FIG. 6.

With regard to the Routine 192 shown in FIG. 9, the first step 194 shown therein is to initialize the pointers as shown. At step 196, the Bill Status Table Number 2 pointer is incremented, and the Time In Transport (BT) from table 2 is loaded. At step 198, the question, "Are there any more bills in the transport?" is posed. If the answer to step 198 is Yes, the routine proceeds to step 200, where a comparison is made between the Time In Transport (BT) for a particular bill coming from Table Number 2 with one of the progress counts located in table number 3. If the Time In Transport or (BT) is less than the bill Progress Count (BP), the routine branches back to point A. If BT is less than BP in the example being described, it indicates that the first bill in the Bill Status Table Number 2 has not as yet progressed to Checkpoint Number 1 shown in Bill Progress Table Number 3. If the BT is greater than or equal to BP as shown at step 202 in FIG. 9, the Bill Progress Table Number 3 pointer is incremented so as to enable the next higher checkpoint in Table Number 3 to be compared with the Time In Transport (BT) at step 204. If the Time In Transport BT equals the Progress Count shown in Table Number 3, then the appropriate subroutine indicated by S in step 208 on FIG. 9 would be initiated to check on the progress of the bill. If in step 204, BT does not equal BP, it indicates that the Time In Transport (BT) is greater than the current BP count, and accordingly the routine 192 returns to point B thereon after incrementing the BP pointer associated with Table Number 3 in step 206. This process is repeated until there are no more bills in the dispensing path 56 as indicated at step 198, and thereafter, the Routine 192 branches to point C thereon which enables the Scan Timer Routine 196 to perform additional functions.

The Time In Transport (BT) entries which are listed in Table Number 2 and the Progress Count (BP) entries in Table Number 3 are arranged in increasing numerical order. This fact facilitates the processing of the entries by the Routine 192 shown in FIG. 9. For example, instead of comparing each of three entries for bills numbered 1 through 3 in the Bill Status Table Number 2 with 6 entries or checkpoints in the Bill Progress Table Number 3, the Routine 192, shown in FIG. 9, provides an instant-type loop situation in which six entries in the Bill Progress Table Number 3 and three entries in the Bill Status Table Number 2 are compared to make a total of nine comparisons instead of eighteen via some prior art technique. Another important feature associated with the Routine 192 is that this Routine makes heavy use of the Short and Long-Term Histories of the input/output sensors listed in Table Number 1. The polling of the sensors in Table No. 1 is done every ten milliseconds, and the Routine 192 shown in FIG. 9 is also initiated every ten milliseconds. This Routine 192 does not have to poll the Sensors Numbers 1 through 4 because there is a complete history of the various states of the sensors located in Table Number 1. The various subroutines indicated by the general term "S" in step 208 of Routine 192 of FIG. 9 relate to the Bill Progress Routines for Check Points Nos. 1–6 shown in FIG. 12; these routines shown in FIG. 12 are initiated about every 70 to 200 milliseconds in the embodiment being described herein.

The handling of data in the Tables Nos. 1–3, alluded to earlier herein, will now be discussed in relation to FIGS. 4–6, respectively.

If the Short-Term History for the Single Sensor No. 1 results in the binary pattern of XXXX0001 as indicated, for example, in FIG. 4 (with the X's indicating don't care bits) it indicates that a new bill is present in the dispensing path 56. The Short-Term History for a double bill is indicated by the pattern XXXX X111 for the Doubles Sensor No. 2. Three consecutive binary "1s" were selected to indicate the presence of a "double bill" because in some isolated situations, a dark spot of ink on a single bill erroneously gave an indication of a double bill. The Short-Term History binary bit pattern to indicate that a bill is clear of the Exit Sensor No. 3 is XXXX XX00; the same pattern exists for the Reject Sensor No. 4 to indicate that a bill is clear of the Reject Sensor No. 4.

The Long-Term History count shown in Table No. 1 in FIG. 4 is simply a count of the number of times that a bill was present or sensed at each of the Sensors Nos. 1–4; in the embodiment being described, a binary one is added each time a bill was sensed at each of these Sensors.

With regard to the Bill Status Table No. 2 of FIG. 5, the binary bits shown therein are typical patterns which may be encountered for various bills within the dispensing path 56. After a new bill is detected in the dispensing path 56, a binary "1" is added to the Time In Transport count for that particular bill each time a polling of the Sensors Nos. 1–4 is effected. Because the dispensing mechanism 20 (FIG. 1) moves a bill at a constant velocity through the dispensing path 56, the Time In Transport count gives an indication of the physical progress of the bill through the dispensing path 56. The Status Of Bill bits shown for Bills Nos. 1–3 in Table No. 2 simply indicate that a "bill is present" in the dispensing path 56 for each of these bills.

The "Determine Whether A Bill Requires a Progress Check" Routine 192 shown in FIG. 9 utilizes the Time In Transport (BT) counts shown in Table No. 2 and the Progress Counts (BP) shown in Table No. 3 as previously described. For Check Point 1 shown in Table No. 3, a binary count of 7 (0000 0111) and a symbolic label FWTSFU are shown therein. From what has been earlier described in relation to Routine 192, because the (BT) count from Table No. 2 for Bill No. 1 is greater than the (BP) count for Check Point 1 in Table No. 3, for example, the (Table No. 3) pointer is incremented as shown in step 202 of FIG. 9. When a (BT) count from Table No. 2 equals a (BP) Count from Table No. 3 as shown for Bill No. 3 on Table No. 2 and Check Point 5 in Table No. 3, for example, the routine for Check Point 5 is initiated as shown in step 208 of FIG. 9. From Table No. 3, the address of the routine to check on the progress of the Bill No. 3 for Check Point 5 is shown as FWXCϕϕ. The address FWXCϕϕ is also shown under "Operand" for Memory Location line OOCF shown in FIG. 12. The Symbolic Label for the (BP) count shown for Check Point 5 is FWTSXC, and this same label is shown under the Column "Operands" for Check Point 5 on the listing shown in FIG. 12. The actual routine for Check Point 5 to check on whether or not the bill is clear of the Exit Sensor No. 3 or the Reject Sensor No. 4 is shown in FIG. 19. The Symbolic Labels, such as FWTSFU for Check Point 1 shown in the (BP) Column in Table No. 3, are shown under the column entitled Operands in FIG. 12.

The Time In Transport (BT) entries for Bills Nos. 1–4 shown in Table No. 2 and the Progress Count (BP) entries for Check Points 1–5 shown in Table No. 3 are arranged in ascending order. This feature allows the Routine 192 shown in FIGS. 9 and 11 to find an exact match between the (BT) and (BP) entries with a single pass through each of the Tables Nos. 2 and 3, thereby providing an efficient means for checking on the progress of the bills in the dispensing path 56. Once a match between the (BT) and (BP) entries is found, the jump instruction associated with the (BP) count in Table No. 3 is utilized to transfer control to the appropriate check routines for Check Points 1–6.

The detail listing of the routine associated with the jump instruction FWFUϕϕ associated with the (BP) Count for Check Point 1 in Table No. 3 is shown in FIG. 15. Similarly, the detail listing of the routine FWFCϕϕ for Check Point 2 is shown in FIGS. 16A and 16B. The detail listing of the routine FWDCϕϕ for Check Point 3 is shown in FIGS. 17A and 17B. The detail listing of the routine FWXUϕϕ for Check Point 4 is shown in FIGS. 18A and 18B. The detail listing of the routine FWXCϕϕ for Check Point 5 is shown in FIG. 19; and the detail listing of the routine FWROϕϕ for Check Point 6 is shown in FIG. 20.

The Short Term and Long Term Histories from Table No. 1 are utilized in varying degrees in the routines associated with Check Points 1–6 enumerated in the previous paragraph. For example, from the Routine FWFUϕϕ for Check Point 1 shown in the detail listing in FIG. 15, if a bill being examined is too short, an Operand FWHBSB as shown on the line listing for Memory Location 03A5 would indicate the Status Code for that particular bill, the definitions of the various Bill Status Codes being shown in FIG. 13. From FIG. 13 for a Symbolic Label of FWHBSB, a value of 04H (Hex Code) would be placed in the Status of Bill (Table No. 2) for that particular bill. The necessity of diverting this short bill is also shown on the Memory Location line 03A5 by the Operand FWHBDV, and from FIG. 13, the operand 40H (to divert the bill would also be placed in the Status Of Bill (Table No. 2) for that particular bill. From what has been described, the utilization of the Short Term and Long Term Histories for the routines associated with the Check Points 2–6 would appear to be self-explanatory from a reading of these routines.

As a new bill is encountered in the dispensing path 56, the data relative to that bill is pushed into the first entry (Bill No. 1) in the Bill Status Table No. 2, and when there are other bills in the dispensing path 56, the data relating to these other bills is "bumped up" one entry so that the data relating to a bill which was Bill No. 1, for example, becomes Bill No. 2, etc. When a bill clears the Exit Sensor No. 3 or the Reject Sensor No. 4, all binary 0's would be placed in the last entry on Table No. 2, clearing the last entry, which is really Bill No. 3 because in the embodiment being described, the Bill No. 4 entry is not normally used.

In the embodiment described, a bill length of 174 millimeters is the longest bill length that was anticipated to be dispensed by the dispensing mechanisms 20 and 104; this length is sufficient for handling U.S. and most foreign currencies. The average velocity of a bill 28 being fed in the dispensing path 56 is between a maximum velocity of 0.961 millimeters per millisecond and a minimum velocity of 0.835 millimeters per millisecond.

After the desired number of low bills and high bills is dispensed by the low bill dispensing mechanism 20 and the high bill dispensing mechanism 104, respectively, the usual transaction receipt is routinely printed in step 210 in FIG. 3, and additional customer transaction requests may be satisfied, conventionally, in step 212 in FIG. 3 along with the updating of the associated files.

What is claimed is:

1. A document dispensing system comprising:
a dispensing path;
means for feeding documents from a source to and along said dispensing path;
sensors positioned along said dispensing path to detect the presence or absence of said documents in said dispensing path;
means for sampling said sensors to produce first and second states therein in accordance with the presence or absence, respectively, of said documents in said dispensing path;
first means for storing said first and second states to provide short-term and long-term histories of said states of each of said sensors;
second means for storing status data including a time in transport in said dispensing path for each of said documents in said dispensing path; and
means utilizing said short and long-term histories of said states and said times in transport for evaluating the status of each of said documents in said dispensing path with regard to predetermined criteria to control the disposition of each said document.

2. The system as claimed in claim 1 in which said second means and said utilization means have a capability of handling more than one said document in said dispensing path at any one time.

3. A document dispensing system comprising:
a dispensing path;
means for feeding documents from a source to and along said dispensing path;
a customer access receptacle;
a reject bin;
means located in said dispensing path for diverting said documents into either said reject bin or said customer access receptacle in response to a control signal;
sensors positioned along said dispensing path to detect the presence or absence of said documents in said dispensing path;
means for sampling said sensors to produce first and second states therein in accordance with the presence or absence, respectively, of said documents in said dispensing path;
first means for storing said first and second states to provide short-term and long-term histories of said states of each of said sensors;
second means for storing status data including a time in transport in said dispensing path for each of said documents in said dispensing path; and
means utilizing said short and long-term histories of said states and said times in transport for evaluating the status of each of said documents in said dispensing path with regard to predetermined criteria to thereby produce said control signal to control the diverting of each said document into said customer access receptacle or said reject bin.

4. The system as claimed in claim 3 in which said first means includes a means for storing a predetermined number of the most recent said first and second states of said sensors to produce said short-term histories of said states of each of said sensors.

5. The system as claimed in claim 4 in which said first means also includes a counting means for counting one of said first and second states of said sensors to produce said long-term histories of said states of each of said sensors.

6. The system as claimed in claim 5 in which said predetermined criteria comprise a plurality of counts which correspond to predetermined times at which said documents should be located at predetermined areas in said dispensing path, and in which said utilizing means comprises means for comparing said time in transport for each of said documents with said plurality of counts to select one of said counts of said plurality of counts when a particular one of said times in transport is equal thereto, and in which said utilizing means further comprises means responsive to said selected one of said counts for effecting said evaluating of the status of a particular one of said documents whose said time in transport equals said selected one of said counts to produce said control signal for said particular one of said documents.

7. The system as claimed in claim 6 in which said times in transport are stored in said second means in numerically increasing order, and said utilizing means further includes storage means for storing said plurality of counts in numerically increasing order to facilitate said comparing of said time in transport for each of said documents with said plurality of counts.

8. The system as claimed in claim 7 in which said second means and said utilization means have a capability of handling more than one said document in said dispensing path at any one time.

9. The system as claimed in claim 1 in which said sensors comprise:

a first sensor for detecting one or more of said documents being fed from said source to said dispensing path;

a second sensor for detecting the presence or absence of double thickness documents in said dispensing path;

a third sensor for detecting the presence or absence of said documents being diverted into said reject bin; and a fourth sensor for detecting the presence or absence of said documents being diverted into said customer access receptacle.

10. The system as claimed in claim 9 in which said sampling means simultaneously sample said first, second, third and fourth sensors at a constant periodic rate and said feeding means feed said documents along said dispensing path at a substantially constant velocity.

11. A document dispensing system for dispensing first and second documents comprising:

first and second dispensing mechanisms for dispensing said first and second documents, respectively;

a customer access receptacle;

a reject bin;

each said first and second dispensing mechanism comprising:

a dispensing path;

means for feeding the said documents from a source to and along said dispensing path;

a diverter means located in said dispensing path for diverting said documents into either said reject bin or said customer access receptacle in response to a control signal;

sensors positioned along said dispensing path to detect the presence or absence of documents in said dispensing path;

means for sampling said sensors to produce first and second states therein in accordance with the presence or absence, respectively, of said documents in said dispensing path;

first means for storing said first and second states to provide short-term and long-term histories of said states of each of said sensors;

second means for storing status data including a time in transport in said dispensing path for each of said documents in said dispensing path; and means utilizing said short and long-term histories of said states and said times in transport for evaluating the status of each of said documents in said dispensing path with regard to predetermined criteria to thereby produce said control signal to control the diverting of each said document into said customer access receptacle or said reject bin.

12. A method of dispensing documents comprising:

feeding documents along a dispensing path;

sampling each of a plurality of sensors positioned along said dispensing path to produce first and second states for each said sensor each time a said sensor detects the presence or absence, respectively, of one of said documents thereat;

storing said first and second states of each of said sensors to provide short-term and long-term histories of said states of said sensors;

storing status data including a time in transport in said dispensing path for each of said documents; and utilizing said short and long term histories of said states and said times in transport in said dispensing path for evaluating the status of each of said documents in said dispensing path with regard to predetermined criteria and for controlling the disposition of said documents.

13. A method of dispensing documents comprising:

feeding documents along a dispensing path;

sampling each of a plurality of sensors positioned along said dispensing path to produce first and second states for each said sensor each time a said sensor detects the presence or absence, respectively, of one of said documents thereat;

storing said first and second states of each of said sensors to provide short-term and long-term histories of said states of said sensors;

storing status data including a time in transport in said dispensing path for each of said documents; and utilizing said short and long term histories of said states and said times in transport in said dispensing path for evaluating the status of each of said documents in said dispensing path with regard to predetermined criteria and for producing a control signal and diverting each said document into either a reject bin or a customer receptacle in response to said control signal.

14. The method as claimed in claim 13 in which said storing step to provide said short term history is effected by storing a predetermined number of the most recent states of each of said sensors.

15. The method as claimed in claim 14 in which said storing step to provide said long term history is effected by counting said first and second states for each said sensor.

16. The method as claimed in claim 15 in which said predetermined criteria comprise a plurality of counts which correspond to predetermined times at which said documents should be located at predetermined areas in said dispensing path, and in which said utilizing step comprises comparing said time in transport for each of said documents with said plurality of counts for selecting one of said counts of said plurality of counts when a particular one of said times in transport is equal thereto, and in which said utilizing step comprises utilizing said count from said selecting step for initiating said evaluating of said status of the associated said document.

17. The method as claimed in claim 16 in which said comparing step is effected by arranging said plurality of counts and said times in transport in ascending order to enabling said selecting step to be effected in one pass through said plurality of counts and said times in transport.

* * * * *